US005528258A

United States Patent [19]

Moon

[11] Patent Number: 5,528,258

[45] Date of Patent: Jun. 18, 1996

[54] CHANGEABLE SIGNBOARD

[75] Inventor: Shin K. Moon, Seoul, Rep. of Korea

[73] Assignee: Young S. Chung, Montebello, Calif.

[21] Appl. No.: 165,554

[22] Filed: Dec. 10, 1993

Related U.S. Application Data

[63] Continuation of Ser. No. 891,876, Jun. 3, 1992, abandoned.

[51] Int. Cl.[6] ..... G09G 3/00

[52] U.S. Cl. ..... 345/110; 40/473; 40/503; 340/815.87; 340/815.58

[58] Field of Search ..... 345/108, 110, 345/111; 340/815.58, 815.87, 825.44, 815.86; 40/466, 470, 473, 484, 493, 501, 503–507, 509; 273/153 R

[56] References Cited

U.S. PATENT DOCUMENTS

| | | | |
|---|---|---|---|
| D. 281,336 | 11/1985 | Algren | D20/21 |
| D. 299,211 | 1/1989 | Algren | D8/360 |
| 3,199,098 | 8/1965 | Schwartz | 340/764 |
| 3,267,595 | 5/1963 | Levy | 345/111 |
| 3,614,727 | 10/1971 | Fritts | 340/905 |
| 3,789,395 | 1/1974 | Michels | 345/111 |
| 4,021,946 | 5/1977 | Bradshaw | 40/504 |
| 4,030,070 | 6/1977 | Canevari et al. | 340/325 |
| 4,159,162 | 6/1979 | Christoffel | 310/91 |
| 4,160,973 | 7/1979 | Berlin, Jr. | 345/110 |
| 4,189,859 | 2/1980 | Algren | 40/505 |
| 4,384,224 | 5/1983 | Spitler et al. | 310/91 |
| 4,493,998 | 1/1985 | Ichimura | 340/815.08 |
| 4,528,763 | 7/1985 | Algren | 40/505 |
| 4,676,767 | 6/1987 | Algren | 474/84 |
| 4,706,398 | 11/1987 | Browne et al. | 340/815.87 |
| 5,003,716 | 4/1991 | Dyar | 40/503 |
| 5,061,921 | 10/1991 | Lesko et al. | 340/825.44 |
| 5,063,377 | 11/1991 | Smith | 340/764 |
| 5,233,772 | 8/1993 | Bergeron et al. | 40/503 |

FOREIGN PATENT DOCUMENTS

| | | | |
|---|---|---|---|
| 2571528 | 4/1986 | France | 345/110 |

*Primary Examiner*—Richard Hjerpe
*Assistant Examiner*—Lun-Yi Lao
*Attorney, Agent, or Firm*—Robbins, Berliner & Carson

[57] ABSTRACT

A changeable signboard, in which each turning pole is operated by a stepping motor, has three advertisement faces and turns clockwise and counterclockwise at a predetermined degree, thus displaying a certain pattern according to the electronic circuit. As many turning poles as needed can be arranged and one can show linear or curved images and diversify the patterns of advertisements.

11 Claims, 4 Drawing Sheets

CHANGEABLE SIGNBOARD

This application is a continuation of application Ser. No. 07/891,876, filed Jun. 3, 1992, now abandoned.

FIELD OF THE INVENTION

This invention relates to changeable signboard.

BACKGROUND AND SUMMARY OF THE INVENTION

The invention is a changeable signboard. The conventional changeable signboards are as shown in FIG. 4, composed of a large number of fragmental small changeable faces which are fixed on a respective worm gear or barbell gear 2 that is counter-revolving against the screw shaft of the long main shaft, and the faces are to be changed concurrently. When the signboards are installed outdoor or on the rooftop, dust or other foreign material may deposit on or between the worm gears and screw, causing the malfunction of one of them. For example, if teeth of a gear wear out or fail to revolve against the screw, the face of the gear does not turn around causing an undiscernible pattern of advertisement or the whole rig may stop functioning, thus defeating the purpose of the advertisement.

The conventional signboard requires a high power motor to drive the main shaft which consumes a great deal of electricity and demands a vast space to install the motor and its controlling accessories, thus resulting in high cost of installation. Moreover, extended use may cause a deviation to the teeth of the gear by wearing. The deviated turning angle of the gear may result in a different advertisement than the one first intended, and in extended repair cost and trouble. Also, the limited length of the screw gear may enable one to display only the limited pattern of an advertisement.

The present invention compensates the drawbacks of the conventional signboards in the following ways:

1. A stepping motor is installed to each turning shaft of a fragmental face.

2. Each motor is programmed to obtain desired patterns of advertisements.

3. Each fragmental face can turn clockwise or counterclockwise respectively, or can turn to a desired angle and stop.

4. The sign is changeable in part or in whole as desired.

5. The advertisement rig is electronized to obtain a better result of an advertisement and compactness of the system.

6. A parabolic screen may be created if wanted. The invention is not limited to a horizontal or vertical screen which is the case of a conventional signboard.

7. The screen can be widened to be as large as one wishes.

DETAILED DESCRIPTION

Figure 1:
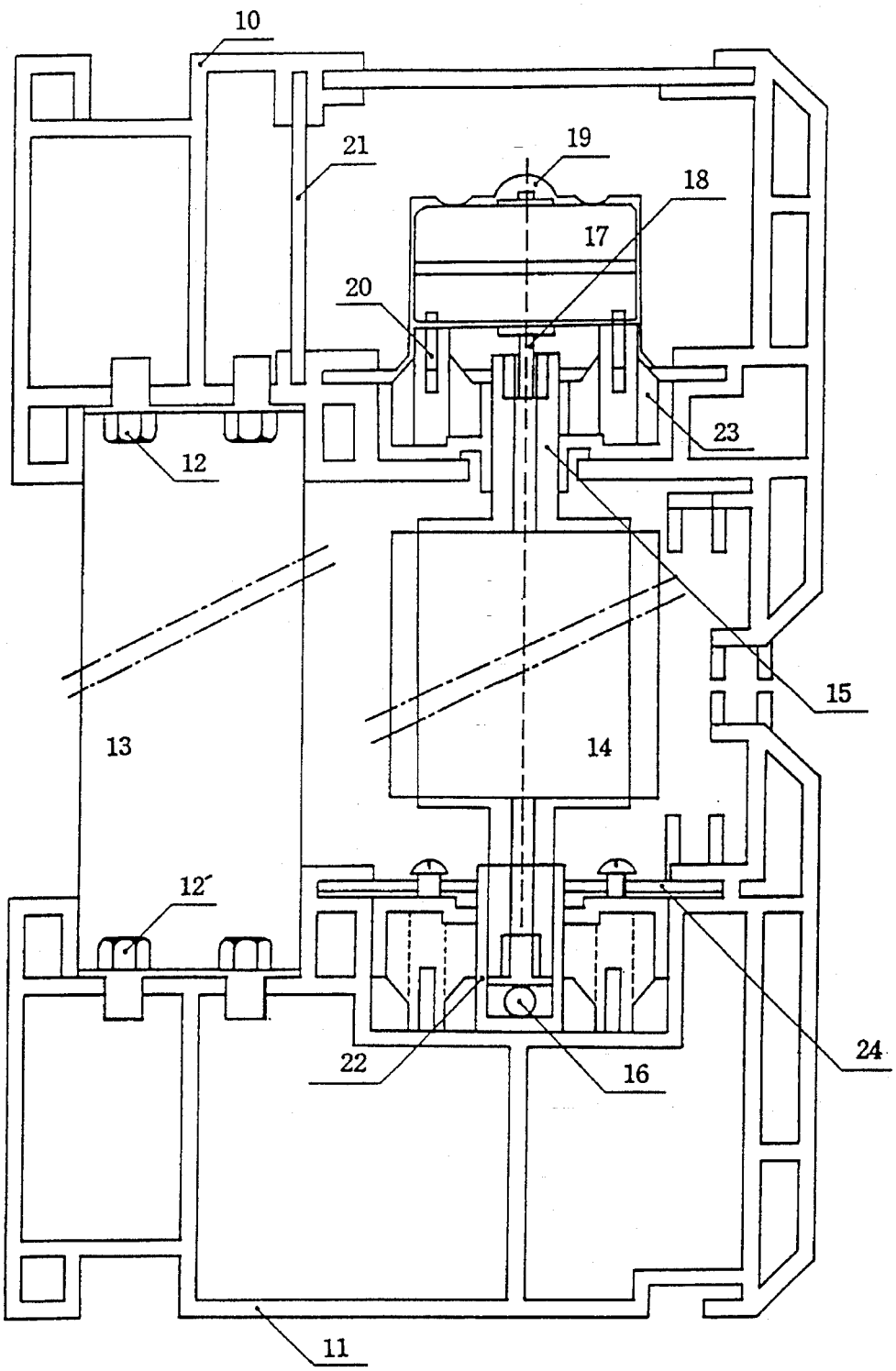
FIG. 1 is a cross-sectional view of a signboard of this invention.
Figure 2:
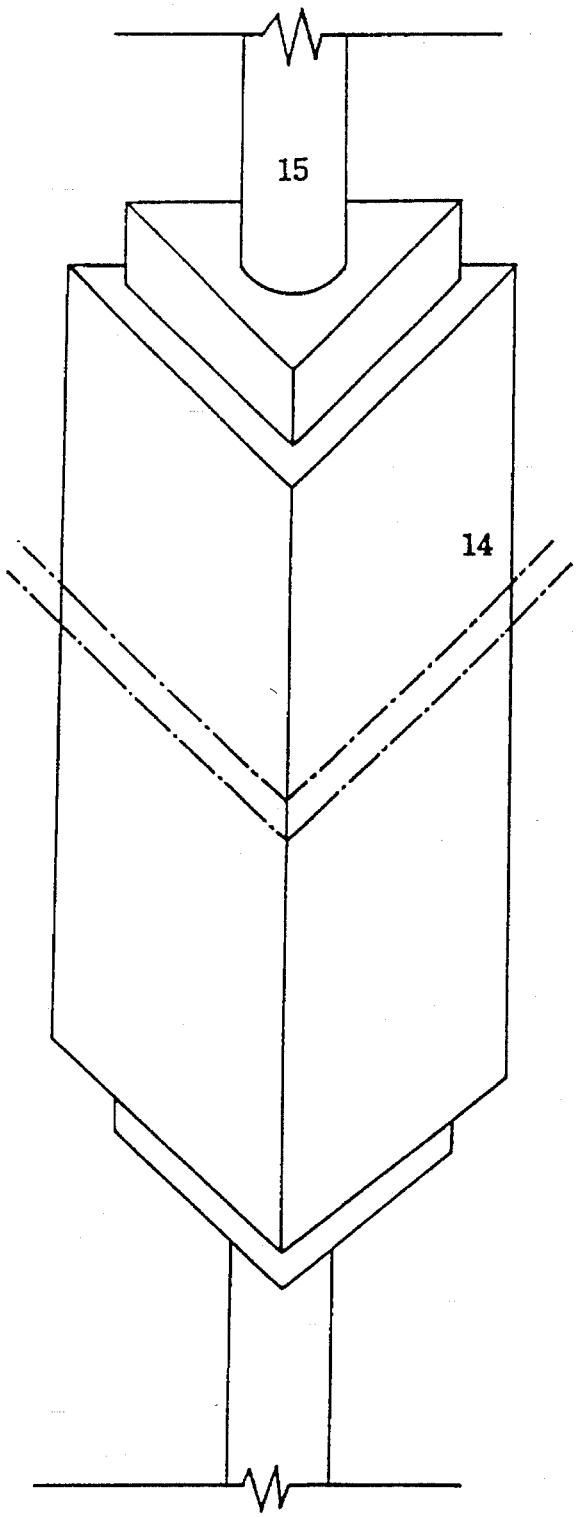
FIG. 2 is a perspective view of a turning pole utilized in this invention.

The upper frame 10 and lower frame 11 are fixed to the fixed unit 13 by bolts 12, 12. Pole shafts 15 of the fragmental faces 14 (or tripole) are connected and jointed to the frames 10, 11 (one pole has three faces in urban area). The bottom end of the shaft is supported by a ball 16 and the upper end is fixed to the stepping motor 17 shaft 18. The stepping motor 17 is fixed to the frame by rubber coupling 20, and secured to the frame 10 by a "horseshoe" type band spring 19.

Also in FIG. 1 are: a circuit board 21 and the bearing housing 22 and 23 of the shaft. The circuit board 21 which contains electrical circuit as shown in FIG. 3, is connected to the power source and to the stepping motor by unseen cable and controls the motor.

Figure 3:
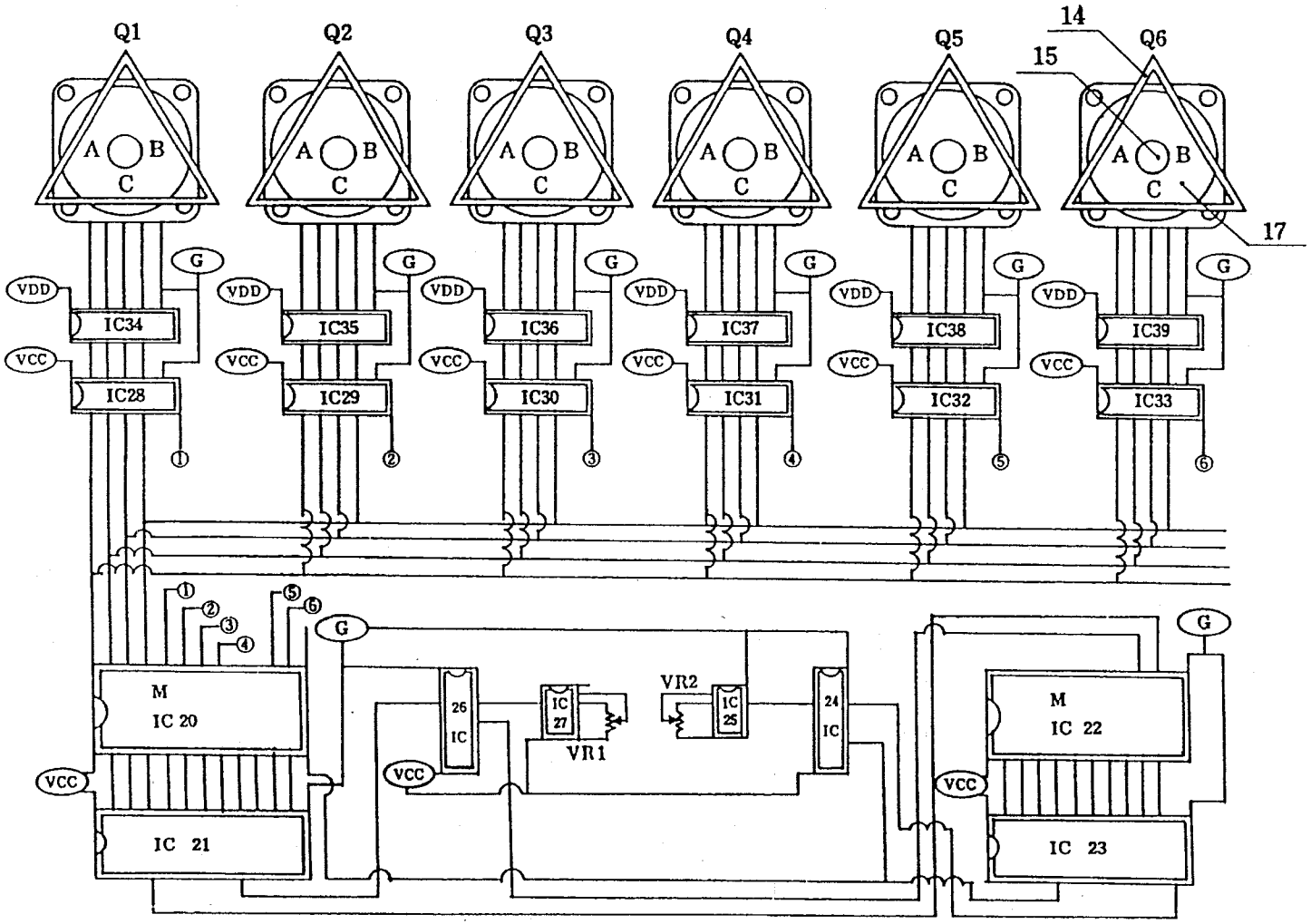
FIG. 3 is a diagram of the circuitry used in this invention.
Figure 4:
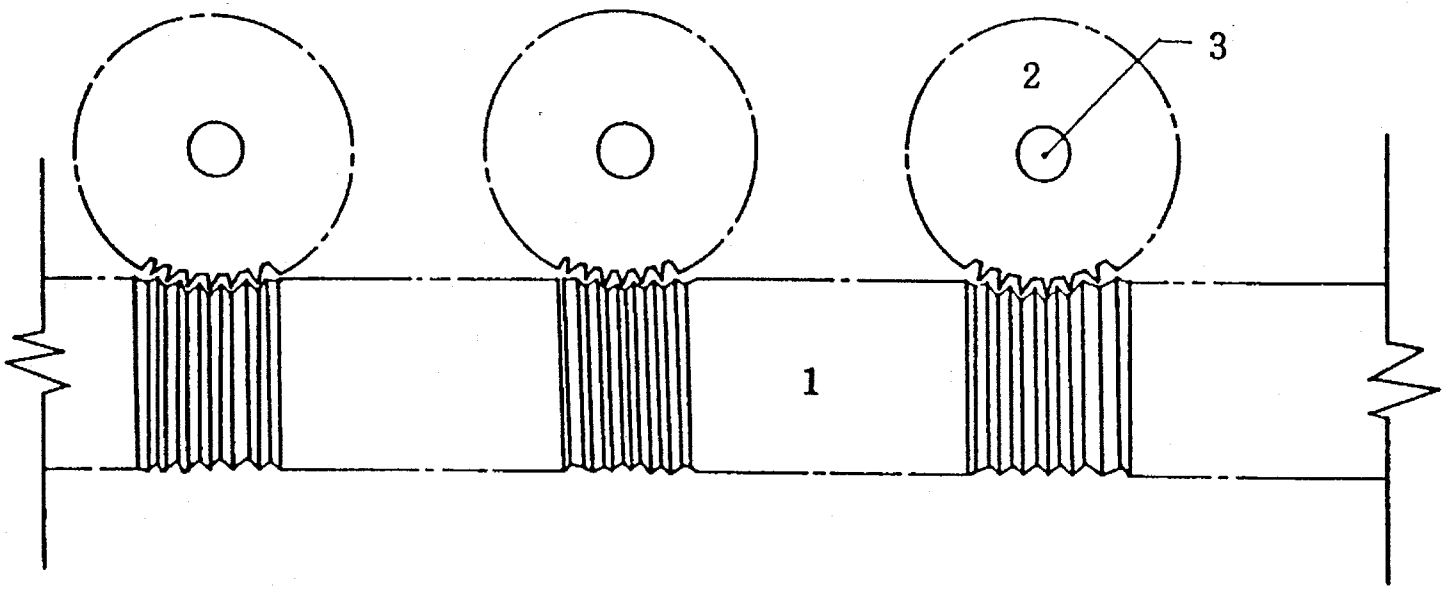
FIG. 4 is a shaft utilized in a conventional signboard.

In FIG. 3, a known timer circuit, which is composed of memory IC (IC 22), address IC (IC 23), gate circuit (IC 24), variable resistor (VR) and oscillating IC (IC 25) controls later mentioned address IC and memory IC. According to the signal of the known time circuit, the variable resistor (VR), oscillating circuit (IC 27), and gate circuit (IC 26) is either "H" or "L" and drives address IC (IC 21) accordingly. Now, the driving signals are driving the buffer circuit (IC 28 - - - IC 30 - - - ). According to the memory data in the memory IC (IC 20), and the amplified signal by the driver-amplifying circuit (IC 24 - - - IC29 - - - ) the motor is turned clockwise or counterclockwise.

The said pole shaft 15 which is connected to the stepping motor 17 shaft 18 has three fragmental (A, B, C) advertisement faces 14. In this embodiment of the invention, each face can turn 120° clockwise or counterclockwise. In case of four faces they turn to the different degree, of course. Accordingly, one can assembly as many pole shafts 15 which are connected to the stepping motor 17 as desired, and one can display linear or curved screen as one wishes, thus bringing in more advertisement effect.

Since you can control the motion of each stepping motor, such as stop, turn left or turn right, according to a memorized pattern, you can change the image in sequence or freeze one image and show the catch phrase only. You can diversify your advertisement bringing in maximized advertisement effect.

To accomplish the above in the present invention, turn the clock signal of the oscillating circuit (IC 27) to the input of the gate circuit (IC 26), output of the gate circuit (IC 26) by the address circuit (IC 21) drives the designated buffer circuit (IC 28 - - - IC 33 - - - ), which is parallel-connected, according to the known data (1), (2), (3), (4), (5), (6) - - - which are memorized in the memory IC (IC 21) and the signals which are amplified by the driver-amplifying to stop, turn right or left thus creating various patterns (A, B, C) of the fragmental advertisement faces 14 of the shaft.

As explained above, the signboard of this invention can have as many shafts 15 which has three faces (A, B, C) as desired, thus creating any length of pattern and one can show either plain or curved image at one's discretion. One is not limited to the length of the turning shaft and one is also free from mechanical trouble. The time of operation can be controlled such as stopping the display during the non-traffic hours at midnight by controlling the timer circuit.

One can save electricity since an integrated circuit control system is used. The displays can be diversified as shown in the three faces A, B, C. Deviation of the turning shaft can be absorbed since a rubber packing is used between the housing and the stepping motor.

What is claimed is:

1. A changeable signboard comprising an array of aligned elongate turning poles parallel to each other and including a plurality of said poles independent from each other, and a plurality of stepping motors, each independent turning pole being fixed to a respective stepping motor, each turning pole bearing a display member fixed thereto comprising a plurality of equilateral display faces, symmetrically arranged on said pole, each display face extending along a substantial portion of the length of the pole that bears it, each turning pole being rotatable about its axis whereby to rotate said display member thereon, adjacent turning poles being closely aligned but spaced from each other a distance sufficient to permit rotation of each display member, and means for operating said stepping motors whereby to rotate said turning poles in accordance with a predefined pattern to separately selectively display one of said plurality of faces on each display member whereby to cause said faces to form one of a plurality of signboard images from the parallel alignment of faces on adjacent display members.

2. The changeable signboard of claim 1 in which said aligned, parallel turning poles are aligned in a rectilinear array.

3. The changeable signboard of claim 1 in which said aligned parallel turning poles are aligned in a curvilinear array.

4. The changeable signboard of claim 1 in which said stationary aligned turning poles are vertically disposed.

5. The changeable signboard of claim 1 in which each display member comprises three display faces triangularly arranged on each respective pole.

6. The changeable signboard of claim 1, in which the shafts of said stepping motors are directly connected to said respective turning poles.

7. The changeable signboard of claim 1 including stepping motors, housing for said stepping motors, frames, band springs, and rubber couplings, and a memory circuit and an address circuit, said sign-board being operated by said stepping motors according to the output of said memory circuit signaled by said address circuit, the stepping motors being secured to said frames by respective springs, said stepping motors having shafts connected to respective turning poles, said rubber couplings being disposed between respective housing and stepping motors.

8. The changeable signboard of claim 7 in which the turning poles have advertisement faces connected to the housings and are fixed between said frames, said frames being secured by bolts to form a fixed unit.

9. The changeable signboard of claim 1 in which said means for operating said stepping motors comprises a memory circuit and a circuit that addresses said stepping motors, said memory circuit being signaled by said address circuit.

10. The changeable signboard of claim 9 including housings and frames for respective stepping motors, each stepping motor being secured to its respective frame by a band spring, each stepping motor having a shaft connected to its respective turning pole, and rubber couplings between each stepping motor and its respective housing.

11. The changeable signboard of claim 10 in which the turning poles have advertisement faces connected to the housing and are fixed between said frames, said frames being secured by bolts to form a fixed unit.

* * * * *